US005587543A

United States Patent [19]

Da Silva Marques

[11] Patent Number: 5,587,543

[45] Date of Patent: Dec. 24, 1996

[54] MUSICAL INSTRUMENT

[76] Inventor: Carlos A. Da Silva Marques, Rua Vitor Brecheret, 520, Apt. 08-B, Osasco, Sao Paulo, Brazil

[21] Appl. No.: 521,825

[22] Filed: Aug. 31, 1995

[51] Int. Cl.[6] ..... G10D 13/02

[52] U.S. Cl. ..... 84/411 M

[58] Field of Search ..... 84/411 R, 412, 84/420, 411 M

[56] References Cited

U.S. PATENT DOCUMENTS 4,244,266 1/1981 Hardy ..... 84/411 M 4,745,839 5/1988 Peraino ..... 84/411 M 5,088,376 2/1992 Crago et al. ..... 84/411 M

*Primary Examiner*—Patrick J. Stanzione

*Attorney, Agent, or Firm*—Michael J. Striker

[57] ABSTRACT

A musical instrument comprises a body, at least one element movable relative to the body and producing sound, and an inflatable cushion arranged so as to be in contact with the element during playing the instrument.

13 Claims, 2 Drawing Sheets

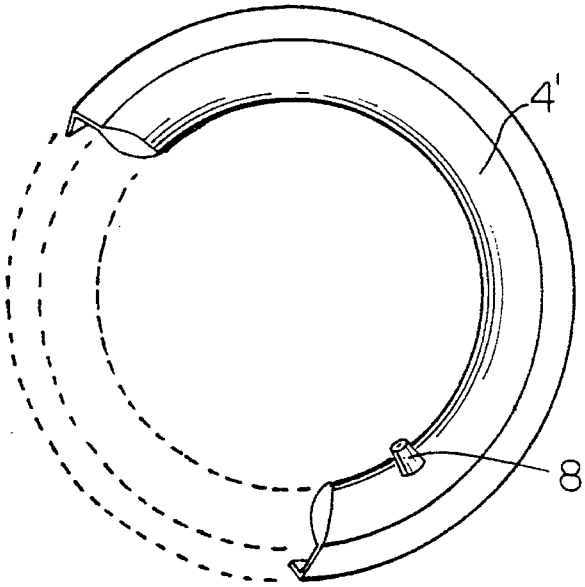
FIG.3
FIG.4
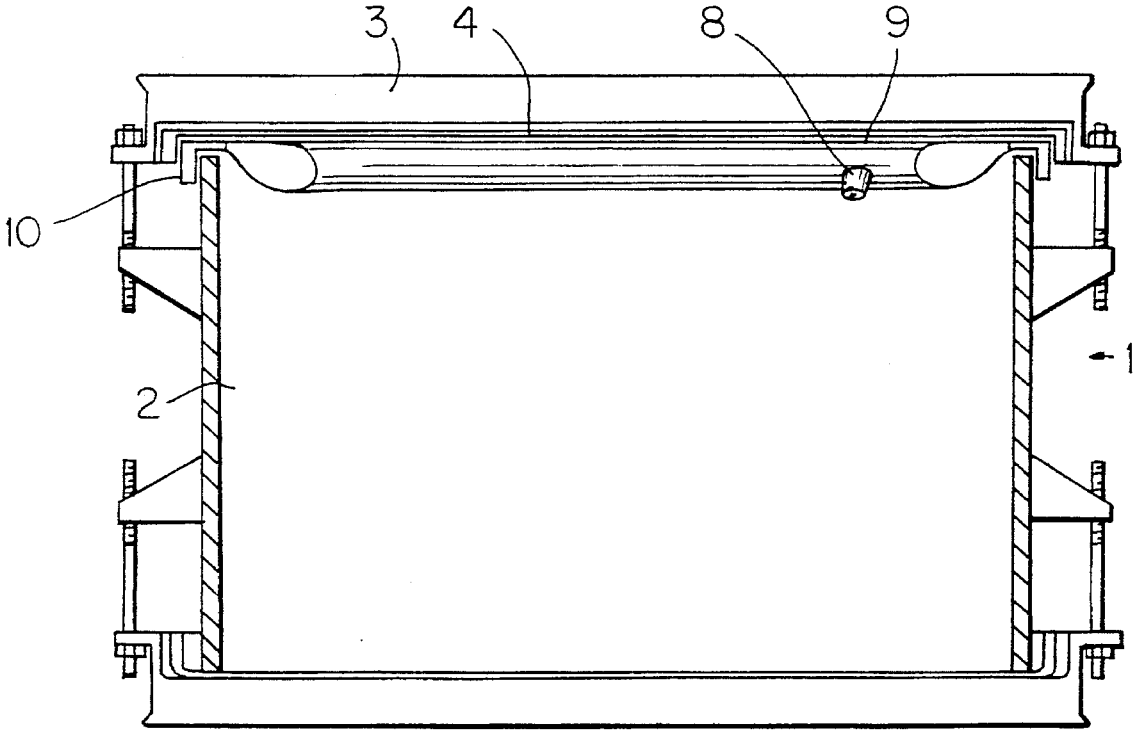

MUSICAL INSTRUMENT

BACKGROUND OF THE INVENTION

The present invention relates to musical instruments.

More particularly, it relates to musical instruments such as drums and other percussion instruments used for performing musical rhymes, particularly by band players.

It is well known that acoustic problems caused by residual vibrations produced by membranes of musical percussion instruments and even timbres of wide open sounds are disagreeable in some drums. In order to avoid these problems, several problems have been made in an attempt to eliminate these excessive vibrations. Some of these proposals include the use of hands, felts and foams adhered to the membranes, or even pillows or folded blankets located inside drums used by band players. These proposals, particular, with regard to the band drums, however do not eliminate satisfactorily those undesirable timbres. Also, the additional elements used for such instruments can hardly be produced with the use of industrial technology.

SUMMARY OF THE INVENTION

It is therefore an object of the present invention to provide a musical instrument of the above mentioned type, which avoids the disadvantages of the prior art.

In keeping with these objects and with others which will become apparent hereinafter, one feature of the present invention resides, briefly stated, in a musical instrument which has a body and an element movable relative to the body so as to produce sound, wherein in accordance with the present invention an inflatable cushion is arranged in the body so as to be in contact with the element which produces sounds and to provide a sound muffling effect.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a plan view of an inflatable cushion in accordance with another embodiment of the present invention; and FIG. 4 is a view showing a drum with the inflatable cushion of FIG. 3 in accordance with the present invention.

DESCRIPTION OF THE PREFERRED EMBODIMENTS

Figure 1:
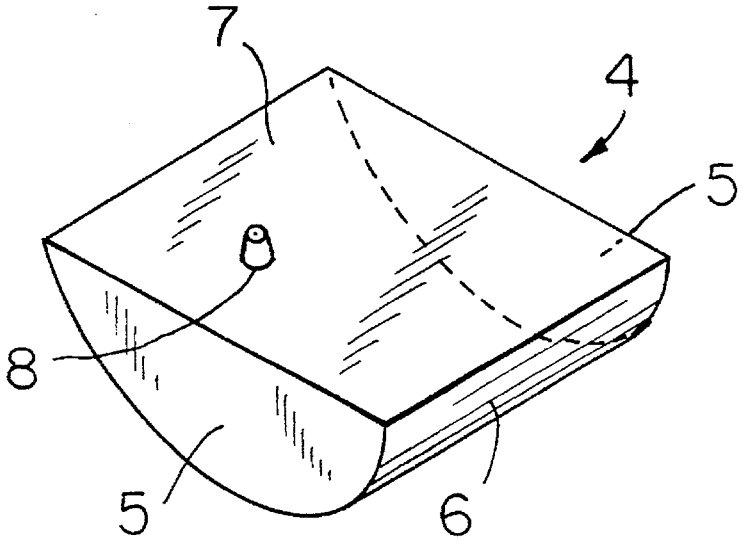
FIG. 1 is a perspective view of an inflatable cushion to be used in a musical instrument in accordance with the present invention.

A musical instrument in accordance with the present invention as illustrated as a drum which is identified as a whole with reference numeral 1. The drum 1 has a cylindrical body 2 and two membranes 3 attached to the body 2. It is to be understood that the membranes 3 are attached to the body 2 removably so that they can be removed from the body and then attached to it again, as well known in the drums.

In accordance with the present invention, the musical instrument further has an inflatable sound muffling cushion which is identified as a whole with reference numeral 4. In the embodiment shown in FIG. 1 the cushion has two circular segment-shaped end surfaces 5, a cylindrical surface 6 and a flat surface 7. The cushion is further provided with an air inflation element formed as an air pressure nipple with a sealing cap or a pneumatic valve 8.

Figure 2:
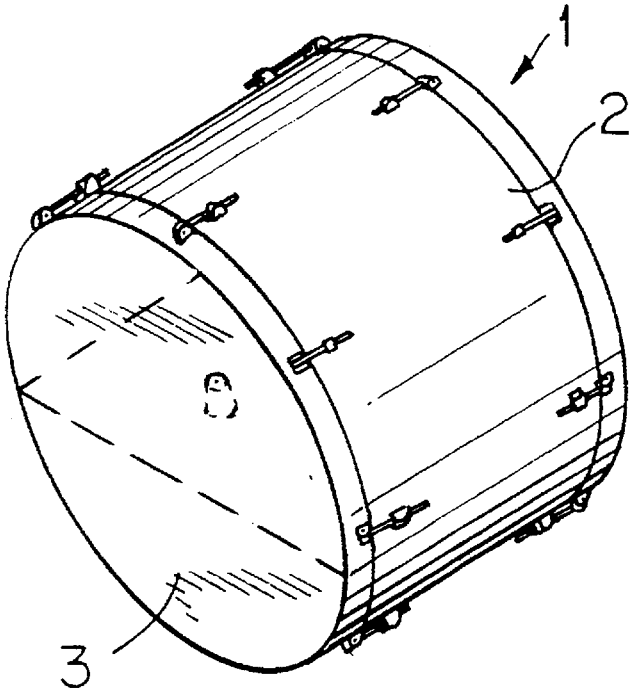
FIG. 2 is a perspective view of a drum with the inflatable cushion in its interior in accordance with the present invention.

As shown in FIG. 2, the inflatable cushion 4 is located in the interior of the drum 2 so that its one circular segment-shaped surface 5 is in contact with one of the membranes 3, at least during the use of the instrument. It is also advantageous when the other circular segment-shaped surface 5 of the cushion 4 abuts against the other not shown membrane of the drum 1.

During playing of the instrument excessive vibrations are eliminated and more pleasant timbres are achieved since the cushion and in particular its circular segment-shaped surfaces abut against the inner faces of the membranes. The inside pressure of the cushion is adjusted in dependence on the desired timbre. To introduce the cushion into the interior of the drum, one of the membranes is removed, the cushion is introduced into the interior and then the membrane is again attached to the body of the drum.

The cushion 4 can be made for example of laminated polyvinylchloride or a similar material. The sheets of the material which form the surfaces of the cushion are electronically welded with one another along the edges of the cushion. The cushion 4 is formed as a single inflatable body of an appropriate shape.

A cushion 4' shown in FIG. 3 is formed as a tubular element which is also provided with the air inflation nipple or pneumatic valve 8. As can be seen from FIG. 4, the cushion 4' is arranged in the drum 1 so that its one axial surface 9 is in contact with the lower face of the membrane 3. The cushion 4' has a radially outer ring-shaped projection 10. The projection 10 is clamped between the lower face of the membrane 3 and the upper edge of the cylindrical body 2 so as to firmly hold the cushion 4' in place.

It will be understood that each of the elements described above, or two or more together, may also find a useful application in other types of constructions differing from the types described above.

While the invention has been illustrated and described as embodied in a musical instrument, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A musical instrument, comprising a body; at least one element movable relative to said body and producing sound; and an inflatable cushion arranged so as to be in contact with said element during playing the instrument, said element being formed as a membrane and said body together with said element forming a drum, said inflatable cushion being ring-shaped and arranged in said body so that it extends along a peripheral portion of said membrane, said inflatable cushion having an axial surface abutting against said membrane, said inflatable cushion having a radially outer ring-shaped projection clamped between said body and said membrane.

2. A musical percussion instrument comprising a body; at least one element movable relative to said body and producing sound, said element being formed as a membrane, said body and said element together forming a drum; an internal inflatable cushion arranged so as to be in contact with said membrane and having a radially outer projection which is clamped between said body and said membrane.

3. A musical instrument as defined in claim 2, wherein said projection is formed as a circular projection.

4. A musical instrument as defined in claim 3, wherein said body and said element together form a percussion instrument.

5. A musical instrument as defined in claim 3, wherein said body and said element together form a drum, said element being formed as a membrane.

6. A musical instrument as defined in claim 5, wherein said inflatable cushion is formed as a part of a cylinder intersected by a plane extending in an axial direction and having two opposite circular segment-shaped end surfaces, a cylindrical surface, and a flat surface, said inflatable cushion being arranged inside said body so that one of said circular segment-shaped surfaces is in contact with said membrane.

7. A musical instrument as defined in claim 6, wherein said drum has another membrane located opposite to said first mentioned membrane, said other circular segment-shaped surface of said inflatable cushion abutting against the other membrane.

8. A musical instrument as defined in claim 5, wherein said inflatable cushion is ring-shaped and arranged in said body so that it extends along a peripheral portion of said membrane, said inflatable cushion having an axial surface abutting against said membrane.

9. A musical instrument as defined in claim 3, wherein said element is removably connected with said body so as to be removed for introduction of said inflatable cushion into an interior of said body and then to be again mounted in said body.

10. A musical instrument as defined in claim 3, wherein said inflatable cushion includes a cushion element provided with an air inflation element.

11. A musical instrument as defined in claim 10, wherein said air inflation element is a nipple.

12. A musical instrument as defined in claim 10, wherein said air inflation element is a pneumatic valve.

13. A musical instrument as defined in claim 2, wherein said projection is formed as a semi-circular projection.

* * * * *